US011046557B2

(12) United States Patent
Tracey et al.

(10) Patent No.: US 11,046,557 B2
(45) Date of Patent: Jun. 29, 2021

(54) ELEVATOR DOOR INTERLOCK ASSEMBLY

(71) Applicant: OTIS ELEVATOR COMPANY, Farmington, CT (US)

(72) Inventors: Michael J. Tracey, Cromwell, CT (US); Richard E. Kulak, Niantic, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 521 days.

(21) Appl. No.: 15/967,846

(22) Filed: May 1, 2018

(65) Prior Publication Data

US 2019/0337767 A1 Nov. 7, 2019

(51) Int. Cl.

| | |
|---|---|
| ***B66B 13/20*** | (2006.01) |
| ***B66B 13/12*** | (2006.01) |
| ***B66B 19/00*** | (2006.01) |

(52) U.S. Cl.

CPC ..... *B66B 13/20* (2013.01); *B66B 13/12* (2013.01); *B66B 19/00* (2013.01)

(58) Field of Classification Search

CPC ..... B66B 13/20; B66B 13/12; B66B 13/16; B66B 13/18

See application file for complete search history.

(56) References Cited

U.S. PATENT DOCUMENTS

| | | | |
|---|---|---|---|
| 1,950,150 | A | 3/1934 | Norton et al. |
| 3,315,767 | A | 4/1967 | Walter |
| 3,638,762 | A | 2/1972 | Johns |
| 4,094,385 | A | 6/1978 | Maeda et al. |
| 4,457,405 | A | 7/1984 | Johns |
| 4,923,055 | A | 5/1990 | Holland |
| 5,538,106 | A | 7/1996 | McHugh et al. |
| 5,651,427 | A | 7/1997 | Kulak et al. |
| 5,651,428 | A | 7/1997 | Ahigian et al. |
| 5,718,055 | A | 2/1998 | Pierce et al. |
| 5,732,796 | A | 3/1998 | Ahigian et al. |
| 5,959,266 | A | 9/1999 | Uchiumi |
| 6,089,355 | A | 7/2000 | Seki et al. |
| 6,173,813 | B1 | 1/2001 | Rebillard et al. |
| 6,446,759 | B1 | 9/2002 | Kulak et al. |

(Continued)

FOREIGN PATENT DOCUMENTS

| | | |
|---|---|---|
| CN | 201610675 U | 10/2010 |
| CN | 204057608 U | 12/2014 |

(Continued)

OTHER PUBLICATIONS

Extended European Search Report for Application No. EP 19 17 2-94 dated Mar. 18, 2020.

(Continued)

*Primary Examiner* — Diem M Tran
(74) *Attorney, Agent, or Firm* — Carlson, Gaskey & Olds

(57) ABSTRACT

An illustrative example elevator door interlock includes a latch situated for pivotal movement about a pivot axis between a door locking position and a released position. At least one base is configured to be selectively movable relative to the pivot axis. A plurality of door movement bumpers are supported on the at least one base. Selective movement of the at least one base relative to the pivot axis adjusts an alignment position of the door movement bumpers.

14 Claims, 3 Drawing Sheets

(56) References Cited

U.S. PATENT DOCUMENTS

| | | | | |
|---|---|---|---|---|
| 6,474,448 | B1 * | 11/2002 | Zappa | B66B 13/20 187/308 |
| 7,147,084 | B2 | 12/2006 | Jahkonen | |
| 7,252,179 | B2 | 8/2007 | Oberleitner | |
| 7,350,623 | B2 | 4/2008 | Kinoshita et al. | |
| 7,398,862 | B2 | 7/2008 | Dziwak | |
| 7,650,971 | B2 | 1/2010 | Pillin et al. | |
| 8,939,262 | B2 | 1/2015 | Schienda et al. | |
| 9,260,275 | B2 | 2/2016 | Reuter et al. | |
| 9,302,886 | B2 | 4/2016 | Tantis et al. | |
| 9,637,350 | B2 | 5/2017 | Mittermayr | |
| 9,656,835 | B2 | 5/2017 | Kitazawa | |
| 9,663,329 | B2 | 5/2017 | Zappa | |
| 9,834,413 | B2 | 12/2017 | Mittermayr | |
| 9,845,224 | B2 | 12/2017 | Rasanen et al. | |
| 10,196,237 | B2 | 2/2019 | Kattainen et al. | |
| 2001/0003319 | A1 * | 6/2001 | Itoh | B66B 13/12 187/333 |
| 2012/0000729 | A1 | 1/2012 | Marvin et al. | |
| 2012/0000732 | A1 | 1/2012 | Draper et al. | |
| 2012/0298453 | A1 * | 11/2012 | Fujii | B66B 13/12 187/330 |
| 2016/0145074 | A1 | 5/2016 | Kattainen et al. | |
| 2017/0190547 | A1 | 7/2017 | Dharmaraj | |
| 2018/0079621 | A1 | 3/2018 | Fauconnet et al. | |
| 2018/0118514 | A1 | 5/2018 | Bruno | |
| 2018/0229972 | A1 | 8/2018 | Kulak et al. | |
| 2018/0265334 | A1 | 9/2018 | Kulak et al. | |
| 2019/0337765 | A1 * | 11/2019 | Wang | B66B 13/30 |
| 2019/0337767 | A1 | 11/2019 | Tracey et al. | |
| 2019/0337768 | A1 | 11/2019 | Kulak et al. | |
| 2019/0337769 | A1 | 11/2019 | Khzouz et al. | |
| 2020/0115192 | A1 | 4/2020 | Montigny et al. | |

FOREIGN PATENT DOCUMENTS

| | | | |
|---|---|---|---|
| CN | 204369335 | U | 6/2015 |
| CN | 103693538 | B | 7/2015 |
| CN | 104773637 | A | 7/2015 |
| CN | 103693539 | B | 11/2015 |
| CN | 103803389 | B | 11/2015 |
| CN | 104176604 | B | 3/2016 |
| CN | 104444734 | B | 3/2016 |
| CN | 105645239 | A | 6/2016 |
| CN | 105936467 | A | 9/2016 |
| CN | 106006324 | A | 10/2016 |
| CN | 106044504 | A | 10/2016 |
| CN | 106081819 | A | 11/2016 |
| CN | 106081820 | A | 11/2016 |
| CN | 106395582 | A | 2/2017 |
| CN | 107176530 | A | 9/2017 |
| CN | 107614412 | A | 1/2018 |
| EP | 1500625 | A1 * | 1/2005 |
| EP | 2426076 | A1 | 3/2012 |
| EP | 3048075 | B1 | 3/2018 |
| GB | 415931 | | 9/1934 |
| GB | 2358623 | A | 8/2001 |
| JP | H0812228 | | 1/1996 |
| JP | H10203742 | A | 8/1998 |
| JP | 2005008371 | | 1/2013 |
| WO | 2005/077808 | A2 | 8/2005 |
| WO | 2006/080094 | A1 | 8/2006 |
| WO | 2011/104818 | A1 | 9/2011 |
| WO | 2011/137545 | A1 | 11/2011 |
| WO | 2014/122358 | A1 | 8/2014 |
| WO | 2016/085678 | A1 | 6/2016 |
| WO | 2016/176033 | A1 | 11/2016 |
| WO | 2017/023927 | A1 | 2/2017 |
| WO | 2017/187560 | A1 | 11/2017 |

OTHER PUBLICATIONS

Extended European Search Report for Application No. EP 19 17 2026 dated Sep. 5, 2019.

Extended European Search Report for Application No. EP 19 17 2040 dated Sep. 23, 2019.

The Extended European Search Report for EP Application No. 19172106.7, dated Jan. 31, 2020.

Extended European Search Report for Application No. EP 19 17 2105 dated Sep. 27, 2019.

* cited by examiner

ELEVATOR DOOR INTERLOCK ASSEMBLY

BACKGROUND

Elevator systems are in widespread use for carrying passengers between various levels in buildings, for example. Access to an elevator car requires that elevator car doors open when the car is at a landing at which a passenger desires to board the elevator car, for example. Each landing includes hoistway doors that move with the elevator car doors between open and closed positions.

There are various known coupler and interlock arrangements for coupling the elevator car doors to the hoistway doors so that the door mover that causes movement of the car doors also causes desired movement of the hoistway doors. Most door couplers include a set of vanes supported on the elevator car door structure. Most interlocks include a set of rollers supported on the hoistway door structure. When the rollers are received adjacent the vanes, it is possible to move both doors together. The movement of the car doors includes one of the vanes pushing on one of the rollers to move the hoistway door in one direction and the other vane pushing on the other roller to move the hoistway door in the other direction.

It is believed that elevator door system components account for approximately 50% of elevator maintenance requests and 30% of callbacks. Almost half of the callbacks due to a door system malfunction are related to one of the interlock functions.

Another drawback associated with known interlock arrangements is that the process of installing the interlocks along the hoistway is time-consuming and undesirably complicated. Each interlock has to be positioned to receive the coupler vanes as the elevator car approaches the corresponding landing. Inaccurate interlock placement may result in undesired contact between the coupler vanes and the interlock as the elevator car passes the landing, for example. Additionally, adjusting the rollers to achieve the necessary alignment with the coupler requires adjusting the position of the corresponding hoistway door lock and switch to ensure that the interlock properly cooperates with the lock. If the lock and switch components are not accurately positioned, the elevator may not perform reliably as indications from the switches along the hoistway are needed to ensure that all hoistway doors are closed before the elevator car moves along the hoistway.

SUMMARY

An illustrative example elevator door interlock includes a latch situated for pivotal movement about a pivot axis between a door locking position and a released position. At least one base is configured to be selectively movable relative to the pivot axis. A plurality of door movement bumpers are supported on the at least one base. Selective movement of the at least one base relative to the pivot axis adjusts an alignment position of the door movement bumpers.

In an example embodiment having one or more features of the elevator door interlock of the previous paragraph, the at least one base is selectively movable horizontally relative to the pivot axis.

In an example embodiment having one or more features of the elevator door interlock of any of the previous paragraphs, the at least one base comprises a bracket including a plurality of slots, the interlock comprises fasteners at least partially received through the slots, and the fasteners selectively secure the at least one base in a fixed position relative to the pivot axis.

In an example embodiment having one or more features of the elevator door interlock of any of the previous paragraphs, a first one of the bumpers is in a first position on the at least one base, a second one of the bumpers is in a second position on the at least one base, and at least one of the first and second positions is adjustable to selectively adjust a spacing between the bumpers.

An example embodiment having one or more features of the elevator door interlock of any of the previous paragraphs includes a latch bumper supported for movement with the latch between the locking and released positions. The latch bumper is configured to be contacted by a door coupler component for moving the latch toward the released position.

In an example embodiment having one or more features of the elevator door interlock of any of the previous paragraphs, there is a gap between the door movement bumpers, the latch bumper is situated relative to the gap such that the door coupler component contacts the latch bumper and urges the latch into the released position when the door coupler component is at least partially in the gap, and the latch bumper is situated relative to the gap when the latch is in the released position so that the latch does not carry any load associated with movement of an associated hoistway door.

In an example embodiment having one or more features of the elevator door interlock of any of the previous paragraphs, a first distance separates the latch bumper from a first one of the door movement bumpers when the latch is in the locking position, a second distance separates the latch bumper from the first one of the door movement bumpers when the latch is in the released position, the first distance is smaller than the second distance and the second distance is at least as large as the gap.

In an example embodiment having one or more features of the elevator door interlock of any of the previous paragraphs, the latch bumper is situated relative to the gap when the latch is in the released position so that the latch does not carry any load associated with movement of an associated hoistway door.

An example embodiment having one or more features of the elevator door interlock of any of the previous paragraphs includes a bracket. The bracket is selectively moveable relative to the latch, the latch bumper is supported on the bracket and the bracket is selectively secured to the latch to fix a position of the latch bumper relative to the pivot axis.

In an example embodiment having one or more features of the elevator door interlock of any of the previous paragraphs, the door movement bumpers comprise rollers.

An example embodiment having one or more features of the elevator door interlock of any of the previous paragraphs includes a lock including a switch and a switch contact supported on the latch that cooperates with the switch to indicate when the latch is in the locking position. The at least one base is selectively movable relative to the lock and the switch and the lock and the switch remain in a fixed position relative to the pivot axis when the at least one base is selectively moved.

An illustrative example method of installing an elevator door interlock, which includes a latch that is configured to pivot about a pivot axis and two bumpers, includes positioning the latch in a selected position relative to a hoistway door component, adjusting a position of at least a first one of the bumpers relative to the latch by moving a base supporting at least the first one of the bumpers relative to the hoistway door component without moving the pivot axis of the latch, and securing the base in a selected position that secures at least the first one of the bumpers in a desired position relative to the hoistway door component.

In an example embodiment having one or more features of the method of any of the previous paragraphs, adjusting the position of the at least first one of the bumpers includes adjusting a position of a second one of the bumpers when moving the base.

In an example embodiment having one or more features of the method of any of the previous paragraphs, moving the base comprises moving the base horizontally relative to the pivot axis.

In an example embodiment having one or more features of the method of any of the previous paragraphs, the elevator door interlock includes a switch that indicates when the latch is in a locked position and the method comprises establishing a position of the switch relative to the pivot axis of the latch before adjusting the position of the first one of the bumpers.

Another illustrative example elevator door interlock includes a latch configured for pivotal movement about a pivot axis between a door locking position and a released position. At least one door movement bumper is situated to be contacted by a door coupler component for moving an associated hoistway door. A latch bumper is supported for movement with the latch between the locking and released positions. The latch bumper is moveable between a first position corresponding to the latch being in the locking position and a second position corresponding to the latch being in the released position. The latch bumper second position is situated relative to the at least one door movement bumper such that the door movement bumper carries any load associated with the door coupler component moving the associated hoistway door and the latch bumper does not carry any of the load associated with moving the associated hoistway door.

An example embodiment having one or more features of the elevator door interlock of any of the previous paragraphs includes at least one base that is configured to be selectively movable relative to the pivot axis. The at least one door movement bumper is supported on the at least one base and selective movement of the at least one base relative to the pivot axis adjusts an alignment position of the at least one door movement bumper.

In an example embodiment having one or more features of the elevator door interlock of any of the previous paragraphs, the at least one base is selectively movable horizontally relative to the pivot axis.

In an example embodiment having one or more features of the elevator door interlock of any of the previous paragraphs, the at least one door movement bumper comprises a plurality of door movement bumpers, there is a gap between the door movement bumpers, the latch bumper is situated relative to the gap such that the door coupler component contacts the latch bumper and urges the latch into the released position when the door coupler component is at least partially in the gap, and the latch bumper is situated relative to the gap when the latch is in the released position so that the latch does not carry any load associated with movement of the associated hoistway door.

In an example embodiment having one or more features of the elevator door interlock of any of the previous paragraphs, the at least one door movement bumper comprises a plurality of door movement bumpers, a first distance separates the latch bumper from one of the door movement bumpers when the latch is in the locking position, a second distance separates the latch bumper from the one of the door movement bumpers when the latch is in the released position, the first distance is smaller than the second distance, and the second distance is at least as large as the gap.

The various features and advantages of an example embodiment will become apparent to those skilled in the art from the following detailed description. The drawings that accompany the detailed description can be briefly described as follows.

DETAILED DESCRIPTION

Embodiments of this invention provide an elevator door interlock that is easily adjustable for properly aligning the interlock with an elevator door coupler. The alignment can be achieved without requiring any adjustment of relative positions of the latch and lock switch components. Embodiments of this invention also separate the door unlocking and door moving functions. In previous interlocks, a roller used to unlock the door lock also carried a significant portion of the load associated with opening the hoistway door. By separating the unlocking and door moving functions, the latch of the interlock and its supporting components do not need to bear the load associated with opening the hoistway door.

Figure 1:
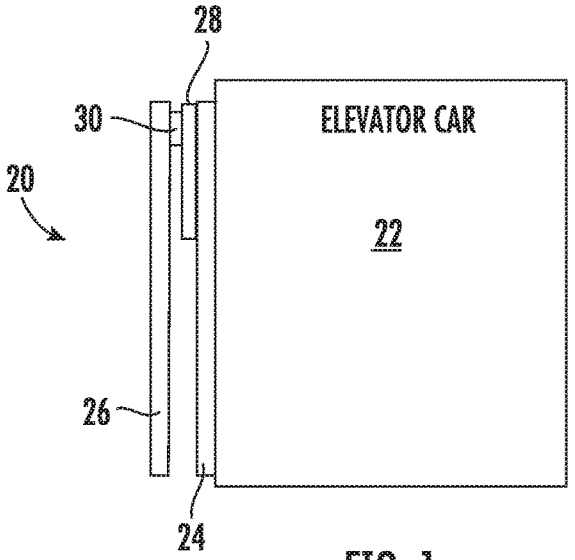
FIG. 1 schematically illustrates selected portions of an elevator system including a door interlock designed according to an embodiment of this invention.

FIG. 1 schematically illustrates selected portions of an elevator system 20. An elevator car 22 includes car doors 24 that are situated adjacent hoistway landing doors 26 when the elevator car 22 is parked at a landing. At least one portion or component of a door coupler 28 associated with the elevator car doors 24 cooperates with an interlock 30 associated with the hoistway doors 26 so that the elevator car doors 24 and the hoistway doors 26 move together between opened and closed positions.

FIGS. 2-5 show the interlock 30 of an example embodiment. The interlock 30 includes a latch 32 that is moveable between a locking position (shown in FIG. 2) and a released position (shown in FIG. 3). A locking surface 34 on the latch 32 engages a stop 36 on a door lock 38 when the latch 32 is in the locking position. In the released position shown in FIG. 3, the locking surface 34 is clear of the stop 36 and the door 26 is free to move with the elevator car door 24.

The lock 38 includes a switch 40. A switch contact 42 supported on the latch 32 cooperates with the switch 40 to provide an indication when the latch 32 is in the locking position. The switch 40 works in a known manner to provide an indication when a corresponding hoistway door 26 is unlocked based on a lack of contact between the switch 40 and the switch contact 42 as shown, for example, in FIG. 3.

A latch bumper 44 is supported on a bracket 46 that is secured to the latch 32. In this example, at least one fastener 48 secures the bracket 46 in a selected position relative to the latch 32.

In the illustrated embodiment, the latch bumper 44 comprises a roller or sleeve supported on the bracket 46. In one example embodiment, the bracket 46 includes a post or boss with a low-friction material sleeve received around the post.

Figure 3:
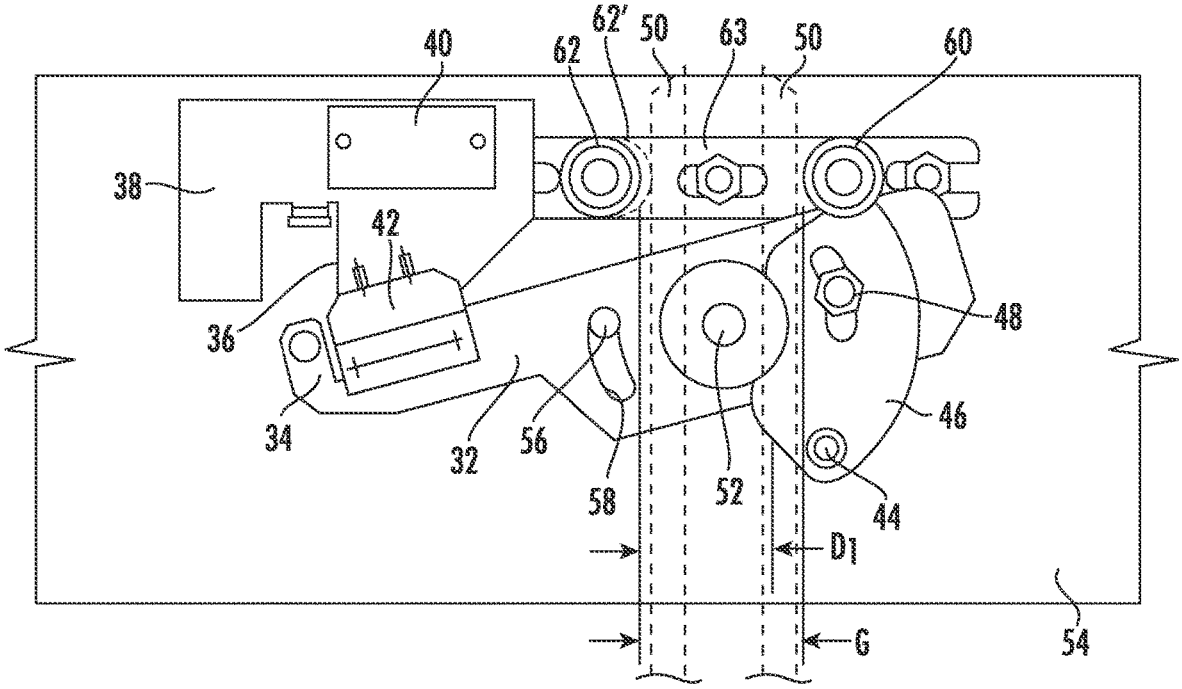
FIG. 3 shows the example interlock of FIG. 2 with the latch in a released position.

As schematically shown in FIG. 3, when a door coupler component 50, such as a vane, contacts the latch bumper 44 and urges it to the right (according to the drawings), that moves the latch 32 into the released position of FIG. 3. The latch 32 is supported to pivot about a pivot axis 52 relative to a door component 54, such as a door hanger. In this example, the door component 54 includes a boss or post 56 that is at least partially received within a slot 58 on the latch 32. The post 56 and the slot 58 cooperate to limit the amount of pivotal movement of the latch 32 relative to the door component 54.

Once the latch 32 is in the released position, the door coupler 28 including the door coupler components 50 can move the hoistway door 26 with the elevator car door 24. The illustrated example interlock 30 includes door movement bumpers 60 and 62. In the example embodiment, the door movement bumpers 60 and 62 comprise rollers supported on at least one base 63.

One feature of the example interlock 30 is that the positions of the bumpers 60 and 62 relative to the door component 54 may be adjusted by selectively moving the base 63 relative to the door component 54. In the illustrated example, a plurality of fasteners 64 are at least partially received through slots 66 on the base 63. When the fasteners 64 are appropriately loosened, the base 63 may be moved linearly and horizontally (i.e., right or left according to the drawings) for purposes of changing a position of the door movement bumpers 60 and 62 relative to the pivot axis 52 of the latch 32. Moving the base 63 and the door movement bumpers 60 and 62 in this manner allows for aligning the bumpers 60 and 62 with the door coupler 28 without having to move or adjust the pivot axis 52 of the latch 32. One of the features of the illustrated example embodiment is that it allows for adjusting the alignment position of the door movement bumpers 60 and 62 without having to change any of the positions of the latch 32, the pivot axis 52, the switch 40 or the lock 38. This reduces the amount of alignment and adjustment required when attempting to align interlocks at a plurality of landings with the door coupler 28 on the elevator car 22.

In one example embodiment, the door movement bumpers 60 and 62 are set in fixed positions on the base 63. In another example embodiment, at least one of the door movement bumpers 60 and 62 is adjustable into more than one position relative to the base 63 as shown in phantom at 62'. For example, an eccentric adjustment feature allows for changing the position of the axis of at least one of the door movement bumper rollers 60 and 62 relative to the base 63 to change a size of a gap G between the bumpers 60 and 62. The fasteners 64 selectively secure the base 63 and the door movement bumpers 60 and 62 in a fixed position relative to the door component 54 to maintain the desired alignment between the door coupler 28 and the door movement bumpers 60 and 62.

Figure 2:
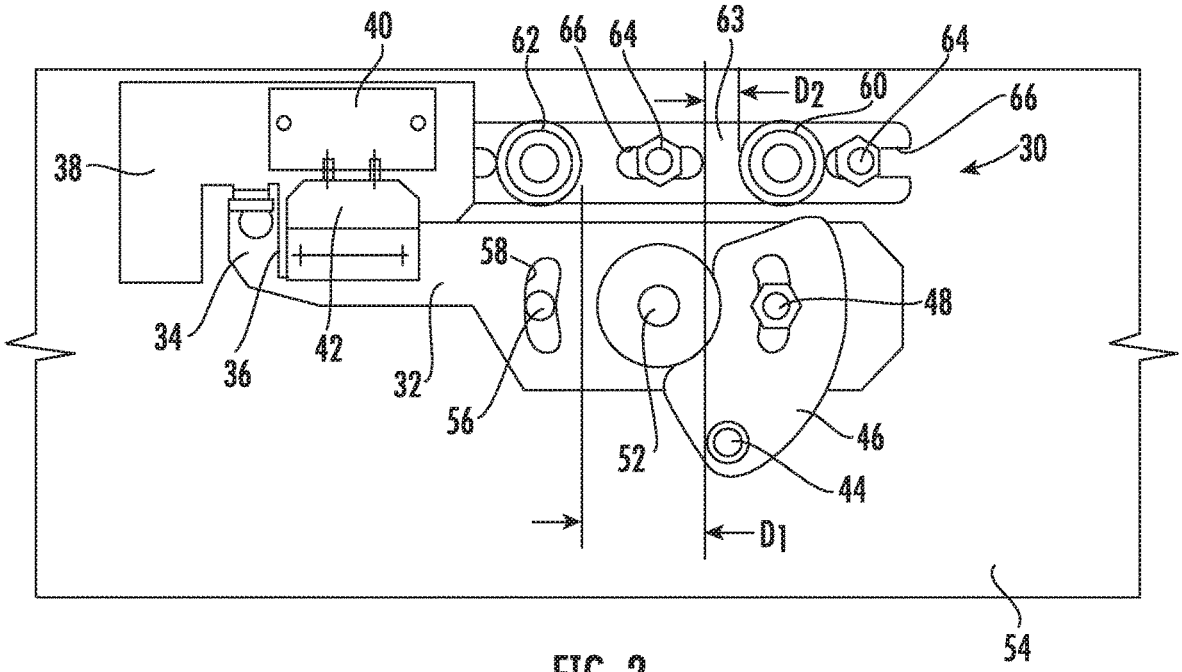
FIG. 2 is schematically shows an example elevator door interlock designed according to an embodiment of this invention with a latch in a locked position.
Figure 4:
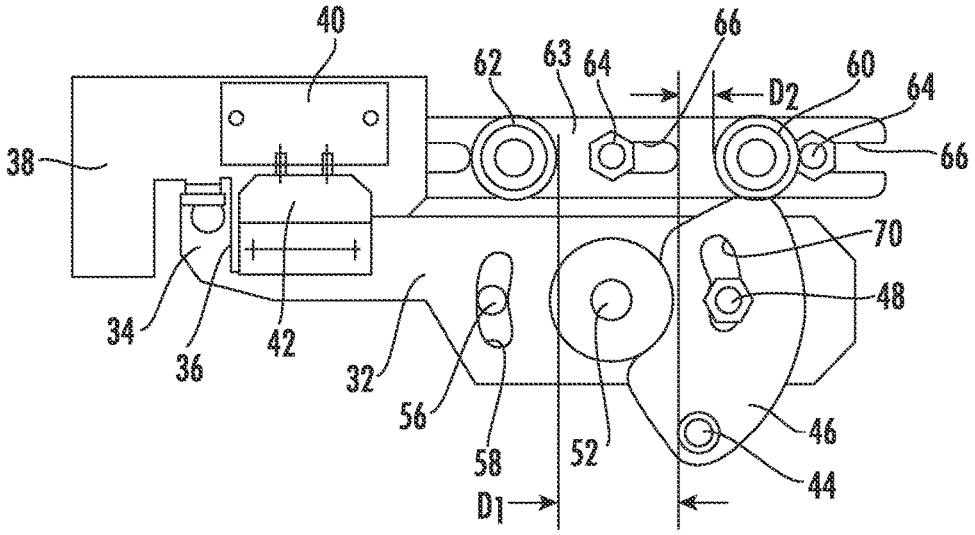
FIG. 4 shows an adjustment feature of the example interlock.
Figure 5:
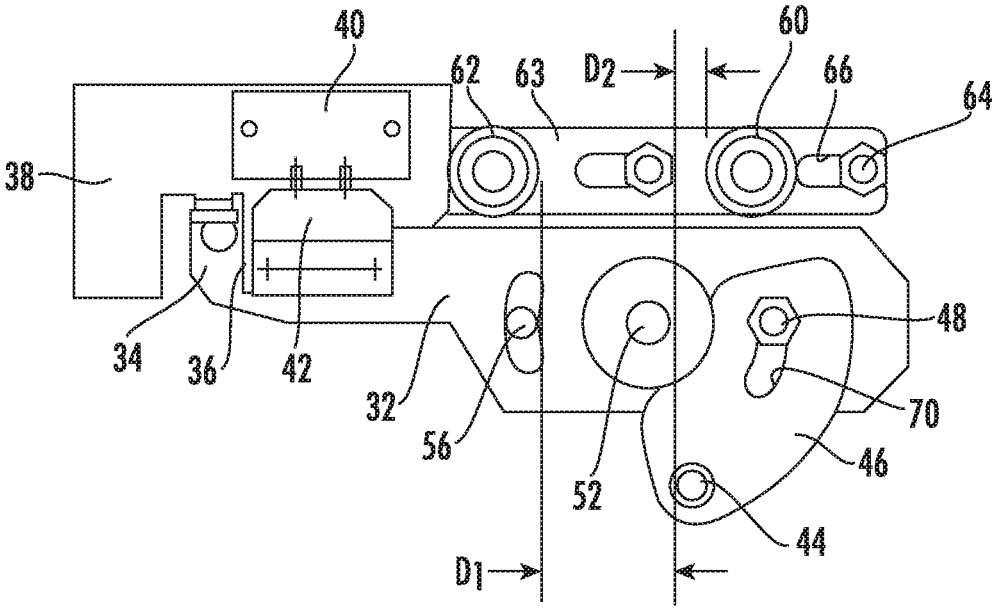
FIG. 5 shows the example interlock in another adjusted configuration.

FIG. 2 illustrates the base 63 in a centered position relative to the pivot axis 52. FIG. 4 illustrates the base 63 moved or shifted to the right (according to the drawings) relative to the pivot axis 52 of the latch 32. FIG. 5 illustrates the interlock 30 in a condition where the base 63 has been moved horizontally to the left (according to the drawings) relative to the position shown in FIG. 2.

Another feature of the example interlock 30 is that the door movement bumpers 60 and 62 carry all of the load associated with moving the hoistway door 26 with the elevator door 24. The latch bumper 44 and latch 32 do not carry any of the load associated with moving the hoistway door. By separating the door unlocking and door movement functions, the illustrated example reduces the load and wear on the components associated with the latch 32 that otherwise bear the load associated with moving the hoistway door 26 in previous interlock designs.

The latch bumper 44 is situated within the gap G between the door movement bumpers 60 and 62 when the latch 32 is in the locking position shown in FIGS. 2, 4, and 5. The latch bumper 44 is situated within the gap G so that it makes contact with a door coupler component 50, such as a vane prior to that same component contacting the door movement bumper 60. As the coupler component 50 moves to the right (according to the drawings), that urges the latch bumper 44 to the right causing the latch 32 to move from the locking position into the released position.

In the locking position, the latch bumper 44 is spaced laterally from the door movement bumper 62 by a first distance $D_1$ as shown, for example in FIGS. 2 and 4. The latch bumper 44 is situated a second distance $D_2$ in a lateral or horizontal direction from the door movement bumper 60. The distances $D_1$ and $D_2$ together equal the size of the gap G between the door movement bumpers 60 and 62. When the latch 32 moves into the released position, the latch bumper 44 moves into a position that is spaced a larger distance from the door movement bumper 62, which corresponds to at least the size of the gap G as can be appreciated from FIG. 3. With the latch bumper 44 in this position, a door coupler component 50, such as a vane, contacts the door movement bumper 60 and the load associated with moving the hoistway door 26 is transferred to the door component 54 through the door movement bumper 60 and base 63 without requiring the latch bumper 44 or the latch 32 and its associated components to carry any of the load associated with moving the door.

The bracket 46 includes a slot 70 that allows for adjusting a position of the latch bumper 44 relative to the door movement bumpers 60 and 62 to achieve the desired amount of movement of the latch 32 into the released position based on contact between the door coupler component 50 and the latch bumper 44. The adjustment of the bracket 46 also ensures that the latch bumper 44 is situated where it will not carry the load associated with moving the door 26 while the latch 32 is in the released position.

Figure 6:
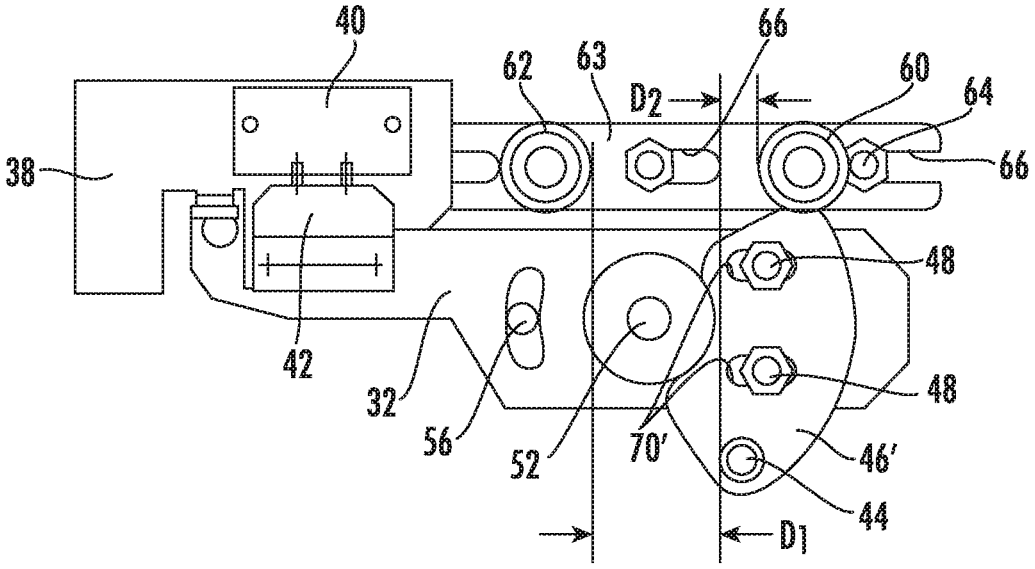
FIG. 6 schematically shows another example elevator door interlock designed according to an embodiment of this invention.

In the embodiment of FIGS. 1-5, the slot 70 is arcuate and allows for pivotally adjusting the position of the latch bumper 44 about the pivot axis 52 of the latch 32. In the example of FIG. 6, the bracket 46' includes two slots 70 that are oriented to allow for linear, horizontal adjustment of the bracket 46' relative to the pivot axis 52. Such translational or horizontal adjustment allows for changing the position of the latch bumper 44 relative to the door movement bumpers 60 and 62 for selecting the appropriate distances $D_1$ and $D_2$ to achieve appropriate interlock operation.

One aspect of the brackets 46 and 46' is that the mass of each serves as a counterweight to bias the latch 32 into the locking position.

Having the ability to adjust the position of the latch bumper 44 and door movement bumpers 60 and 62 without having to move any of the latch 32, pivot axis 52 or switch 40 allows for aligning interlocks 30 along an entire hoistway with the door coupler 28 of the elevator car 22 in a more efficient and economical manner There is no need to adjust the latch 32 or switch contact 42 relative to the lock 38, for example. The relative positions of the pivot axis 52, lock 38, switch 40, and switch contact 42 do not change during adjustment of the bumper positions so there is no risk of a misalignment between the switch 40 and switch contact 42. This feature of the illustrated example enhances the reliability of proper operation of the elevator system and reduces the amount of labor required to achieve proper alignment between the door coupler 28 and the interlocks 30 along the hoistway.

Additionally, the illustrated example embodiments allow for the position of the pivot axis 52, the lock 38, the switch 40, and the switch contact 42 to all be pre-established in a controlled manufacturing setting. The interlock 30 may be installed as a preassembled unit onto a door component 54, such as a door hanger, which further reduces labor, time and cost and further enhances the accuracy of the relative positions of the components of the interlock 30. This type of arrangement leads to a more reliable interlock system and elevator system operation.

Interlocks designed according to an embodiment of this invention facilitate reducing callbacks that are otherwise associated with problems or malfunctions caused by interlock misalignment or wear and tear on the latch and associated components of an interlock. Embodiments of this invention provide cost savings not only during installation or maintenance procedures, but also by reducing the need for maintenance or adjustment during the service life of the associated elevator system.

Different embodiments are shown and described but their respective features are not limited to just those embodiments. For example, at least one of the components of one embodiment may be used in place of a corresponding component of another embodiment. Additional embodiments can be realized by combining various features of the disclosed examples.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator door interlock, comprising:

a latch situated for pivotal movement about a pivot axis between a door locking position and a released position;

a latch bumper supported for movement with the latch between the locking and released positions, the latch bumper being configured to be contacted by a door coupler component for moving the latch toward the released position;

at least one base that is configured to be selectively movable relative to the pivot axis; and a plurality of door movement bumpers supported on the at least one base, wherein selective movement of the at least one base relative to the pivot axis adjusts a position of the plurality of door movement bumpers relative to the pivot axis.

2. The elevator door interlock of claim 1, wherein the at least one base is selectively movable horizontally relative to the pivot axis.

3. The elevator door interlock of claim 2, wherein the at least one base comprises a bracket including a plurality of slots;

the interlock comprises fasteners at least partially received through the slots; and the fasteners selectively secure the at least one base in a fixed position relative to the pivot axis.

4. The elevator door interlock of claim 1, wherein a first one of the plurality of door movement bumpers is in a first position on the at least one base;

a second one of the plurality of door movement bumpers is in a second position on the at least one base; and at least one of the first and second positions is adjustable to selectively adjust a spacing between the bumpers.

5. The elevator door interlock of claim 1, wherein there is a gap between the plurality of door movement bumpers;

the latch bumper is situated relative to the gap such that the door coupler component contacts the latch bumper and urges the latch into the released position when the door coupler component is at least partially in the gap; and the latch bumper is situated relative to the gap when the latch is in the released position so that the latch does not carry any load associated with movement of an associated hoistway door.

6. The elevator door interlock of claim 1, wherein a first distance separates the latch bumper from a first one of the plurality of door movement bumpers when the latch is in the locking position;

a second distance separates the latch bumper from the first one of the plurality of door movement bumpers when the latch is in the released position;

the first distance is smaller than the second distance; and the second distance is at least as large as a gap between the plurality of door movement bumpers.

7. The elevator door interlock of claim 6, wherein the latch bumper is situated relative to the gap when the latch is in the released position so that the latch does not carry any load associated with movement of an associated hoistway door.

8. The elevator door interlock of claim 1, comprising a bracket and wherein the bracket is selectively moveable relative to the latch;

the latch bumper is supported on the bracket; and the bracket is selectively secured to the latch to fix a position of the latch bumper relative to the pivot axis.

9. The elevator door interlock of claim 1, wherein the plurality of door movement bumpers comprise rollers.

10. The elevator door interlock of claim 1, comprising a lock including a switch; and a switch contact supported on the latch that cooperates with the switch to indicate when the latch is in the locking position; and wherein the at least one base is selectively movable relative to the lock and the switch; and the lock and the switch remain in a fixed position relative to the pivot axis when the at least one base is selectively moved.

11. An elevator door interlock, comprising:

a latch configured for pivotal movement about a pivot axis between a door locking position and a released position;

at least one base that is configured to be selectively movable relative to the pivot axis;

at least one door movement bumper supported on the at least one base and situated to be contacted by a door coupler component for moving an associated hoistway door, wherein selective movement of the at least one base relative to the pivot axis adjusts a position of the at least one door movement bumper relative to the pivot axis; and a latch bumper supported for movement with the latch between the locking and released positions, the latch bumper being moveable between a first position corresponding to the latch being in the locking position and a second position corresponding to the latch being in the released position, the latch bumper second position being situated relative to the at least one door movement bumper such that the door movement bumper carries any load associated with the door coupler component moving the associated hoistway door and the latch bumper does not carry any of the load associated with moving the associated hoistway door.

12. The elevator door interlock of claim 11, wherein the at least one base is selectively movable horizontally relative to the pivot axis.

13. The elevator door interlock of claim 11, wherein the at least one door movement bumper comprises a plurality of door movement bumpers;

there is a gap between the plurality of door movement bumpers;

the latch bumper is situated relative to the gap such that the door coupler component contacts the latch bumper and urges the latch into the released position when the door coupler component is at least partially in the gap; and the latch bumper is situated relative to the gap when the latch is in the released position so that the latch does not carry any load associated with movement of the associated hoistway door.

14. An elevator door interlock, comprising:

a latch configured for pivotal movement about a pivot axis between a door locking position and a released position;

at least one door movement bumper situated to be contacted by a door coupler component for moving an associated hoistway door; and a latch bumper supported for movement with the latch between the locking and released positions, the latch bumper being moveable between a first position corresponding to the latch being in the locking position and a second position corresponding to the latch being in the released position, the latch bumper second position being situated relative to the at least one door movement bumper such that the door movement bumper carries any load associated with the door coupler component moving the associated hoistway door and the latch bumper does not carry any of the load associated with moving the associated hoistway door, wherein the at least one door movement bumper comprises a plurality of door movement bumpers;

a first distance separates the latch bumper from one of the door movement bumpers when the latch is in the locking position;

a second distance separates the latch bumper from the one of the door movement bumpers when the latch is in the released position;

the first distance is smaller than the second distance; and the second distance is at least as large as a gap between the plurality of door movement bumpers.

* * * * *